US007874796B2

(12) United States Patent
Chang et al.

(10) Patent No.: US 7,874,796 B2
(45) Date of Patent: Jan. 25, 2011

(54) HEAT DISSIPATION MODULE

(75) Inventors: Shun-Chen Chang, Taoyuan Hsien (TW); Chia-Ming Hsu, Taoyuan Hsien (TW); Tsung-Yu Lei, Taoyuan Hsien (TW); Chin-Sheng Liu, Taoyuan Hsien (TW); Peng-Chu Tao, Taoyuan Hsien (TW); Chia-Ching Lin, Taoyuan Hsien (TW); Shih-Wei Huang, Taoyuan Hsien (TW); Ching-Chuang Mai, Taoyuan Hsien (TW); Wen-Shi Huang, Taoyuan Hsien (TW); Hsiou-Chen Chang, Taoyuan Hsien (TW)

(73) Assignee: Delta Electronics Inc., Taoyuan Hsien (TW)

( * ) Notice: Subject to any disclaimer, the term of this patent is extended or adjusted under 35 U.S.C. 154(b) by 963 days.

(21) Appl. No.: 11/783,228

(22) Filed: Apr. 6, 2007

(65) Prior Publication Data

US 2007/0286720 A1 Dec. 13, 2007

(30) Foreign Application Priority Data

Jun. 8, 2006 (TW) ..... 95120366 A
Jul. 6, 2006 (TW) ..... 95124604 A

(51) Int. Cl.
*F01D 1/02* (2006.01)

(52) U.S. Cl. ..... 415/198.1; 415/193; 415/199.1; 415/199.5; 415/119

(58) Field of Classification Search ..... 415/182.1, 415/184, 185, 187, 190, 193, 194, 198.1, 415/199.1, 199.4, 199.5, 119
See application file for complete search history.

(56) References Cited

U.S. PATENT DOCUMENTS

| | | | | | |
|---|---|---|---|---|---|
| 1,997,506 | A * | 4/1935 | Adamcikas et al. | ..... | 415/192 |
| 2,037,395 | A * | 4/1936 | Seelig | ..... | 415/160 |
| 2,121,073 | A * | 6/1938 | De Bothezat | ..... | 417/247 |
| 2,298,576 | A * | 10/1942 | McElroy et al. | ..... | 415/191 |
| 3,830,587 | A * | 8/1974 | Shipes et al. | ..... | 415/130 |
| 5,136,468 | A * | 8/1992 | Wong et al. | ..... | 361/679.6 |
| 6,454,527 | B2 * | 9/2002 | Nishiyama et al. | ..... | 415/119 |
| 2004/0141841 | A1 * | 7/2004 | Otsuka | ..... | 415/220 |

* cited by examiner

*Primary Examiner*—Igor Kershteyn
(74) *Attorney, Agent, or Firm*—Birch, Stewart, Kolasch & Birch, LLP

(57) ABSTRACT

A heat dissipation module includes a housing, and a fan including an outer frame, a first rotor, a base, a second rotor and a driving device. The first rotor includes a shaft, a first hub and a plurality of first rotor blades disposed around the first hub. The base is disposed in the outer frame. The second rotor includes a plurality of second rotor blades, and is coupled to the shaft of the first rotor and disposed next to the first rotor. The driving device is supported by the base for driving the first rotor and the second rotor simultaneously.

22 Claims, 9 Drawing Sheets

HEAT DISSIPATION MODULE

FIELD OF THE INVENTION

The invention relates to a heat dissipating module, and more particularly to a fan module using a single high-efficiency motor to drive one or more rotors.

DESCRIPTION OF THE RELATED ART

With rapid development of electrical industry, natural convection is gradually being replaced by fans to dissipate heat generated from electronic devices. Motors are used to drive the fans for generating a large volume of airflow to dissipate a lot of heat from electronic elements. The way of increasing the airflow volume is to increase the rotation speed of the fan, but the rotation speed of the fan cannot be arbitrarily increased. When the impeller of the fan rotates at high speed, the blades of the impeller bear large pressure and the loads on the motor and bearings thereof also increase. Accordingly, the blades of the impeller are easily deformed or even broken, and life of the fan is also shortened.

Using two or more assembled fans is an alternative method of solving the above-described problem. The two or more assembled fans rotate at a low speed but achieve the equivalent efficiency like a single fan rotated at a high speed. In FIG. 1, three fans 1, 1' and 1" are arranged in series. The fan 1 is independently driven by a motor 11, the fan 1' is independently driven by a motor 11', and the fan 1" is independently driven by a motor 11". However, when the number of the assembled fans increases, particularly in small electronic devices, the volume, cost and difficulties in deploying the fans and the corresponding motors also increase.

In addition, as the components used in the system increasingly generate a lot heat, several fans must be applied corresponding to each component for reduce the temperature. Alternatively, the fans are disposed at the air inlet or outlet of the system for achieving the purpose of lowering the system temperature. However, the users gradually need more demand and the high-level server often has a plurality of subsystems, each of which adopts several fans to attain the heat dissipating purpose. If one fan in the system is failed, it needs to disassemble the system for replacing the failed fan. This will cause a lot of convenience for the manufacturers or users. Further, in the complicated system, different combination needs different numbers of fans such that it is difficult to arrange the product line, and easily commits faults. Especially, fans play a very important role in the system hardware safety. If the replacement is not good, it will cause a great damage on the system.

Moreover, the vendors must provide different designs or need different product lines according to the client's requirement. For example, Client A needs numerous computation and selects eight subsystems, but Client B does not need such a requirement, selects four subsystems and retains future updated capability. According to the different requirement from the clients, the products need different amount of fans. However, such a way will cause a lot of load and bring annoyance for manufacturers because they need to replace the failed component in the complicated electric system, recover the machines or assign somebody to maintain.

BRIEF SUMMARY OF THE INVENTION

The invention provides a single high-efficiency motor to drive a shaft connected to a plurality of rotors arranged in series. Thus, the total volume of a high-efficiency heat dissipation module can be reduced.

According to the present invention, the heat dissipation module includes a housing, and a fan disposed in the housing and including an outer frame, a first rotor including a shaft, a first hub and a plurality of first rotor blades disposed around the first hub, a base disposed in the outer frame, a second rotor including a plurality of second rotor blades and coupled to the shaft of the first rotor, and a driving device supported by the base for driving the first rotor and the second rotor.

The outer frame includes a plurality of static blades disposed between the first rotor and the second rotor to increase workability of the second rotor, wherein the static blade includes a vertical distal end, and the height ratio of the first and second rotor blades of the first or second rotors to the static blades preferably ranges from 1/1.1 to 1/1.4. The shape of the static blades of the outer frame is similar to that of the first or second rotor blades, or the static blade of the outer frame includes a wing-shaped structure.

The second rotor further includes a second hub, the first hub of the first rotor includes a first top surface, and the shaft passing through the first top surface of the first hub is connected to the second hub of the second rotor by riveting, screwing, adhering or an equivalent way. Alternatively, the second rotor further includes a second hub having a second top surface, and the end of the shaft of the first rotor passes through the second top surface of the second hub to be coupled with the second rotor by riveting, screwing, adhering or an equivalent way.

The heat dissipation module further includes a third rotor coupled to the second rotor, the first rotor or both in series, wherein the second rotor further includes a second hub, the third rotor includes a third hub, and the shaft of the first rotor includes a first end passing through a first top surface of the first rotor to connect with the second hub of the second rotor and a second end passing through the base to connect to the third hub of the third rotor. Alternatively, the second rotor further includes a second hub, the third rotor includes a third hub, and the shaft of the first rotor passes through the second hub of the second rotor to connect with the third hub of the third rotor.

The heat dissipation module further includes a first airflow guiding shroud disposed at one side of the outer frame, and a second airflow guiding shroud disposed at the other side of the outer frame. Preferably, the heat dissipation module further includes a plurality of static blades disposed in the first or second airflow guiding shroud, wherein the first or second airflow guiding shroud includes an outwardly-slanting or trumpet-like periphery, and is connected to the outer frame by engaging, locking, screwing or other equivalent ways.

Additionally, the first or second rotor further includes a plurality of dissipating holes with a slanted side wall, and the first hub of the first rotor includes a cone, tapered or slanted surface.

Preferably, the heat dissipation module further includes a handle coupled to the housing and a securing member engaged with an external system frame so as to fix the heat dissipation module to the external system.

The securing member includes a hook which will be buried inside the housing by rotating the handle so as to disassemble the heat dissipation module from the system.

Preferably, the heat dissipation module further includes a voice absorber disposed in the heat dissipation module to eliminate the noise generated from the heat dissipation module.

According to another aspect of the present invention, the heat dissipation module includes a housing; a fan disposed in the housing and including a frame; at least one rotor including a shaft, a hub and a plurality of rotor blades disposed around the hub; a base disposed in the frame, and a driving device supported by the base for driving the at least one rotor; a securing member mounted on the housing; and a handle coupled to the housing, wherein the handle is rotated for assembling/disassembling the heat dissipation module with/from an external system.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

The invention provides a single high-efficiency motor to drive a plurality of rotors which are modularized for being assembled with/disassembled from the system so as to increase the manufacturing and sales amount and the maintaining convenience.

Figure 1:
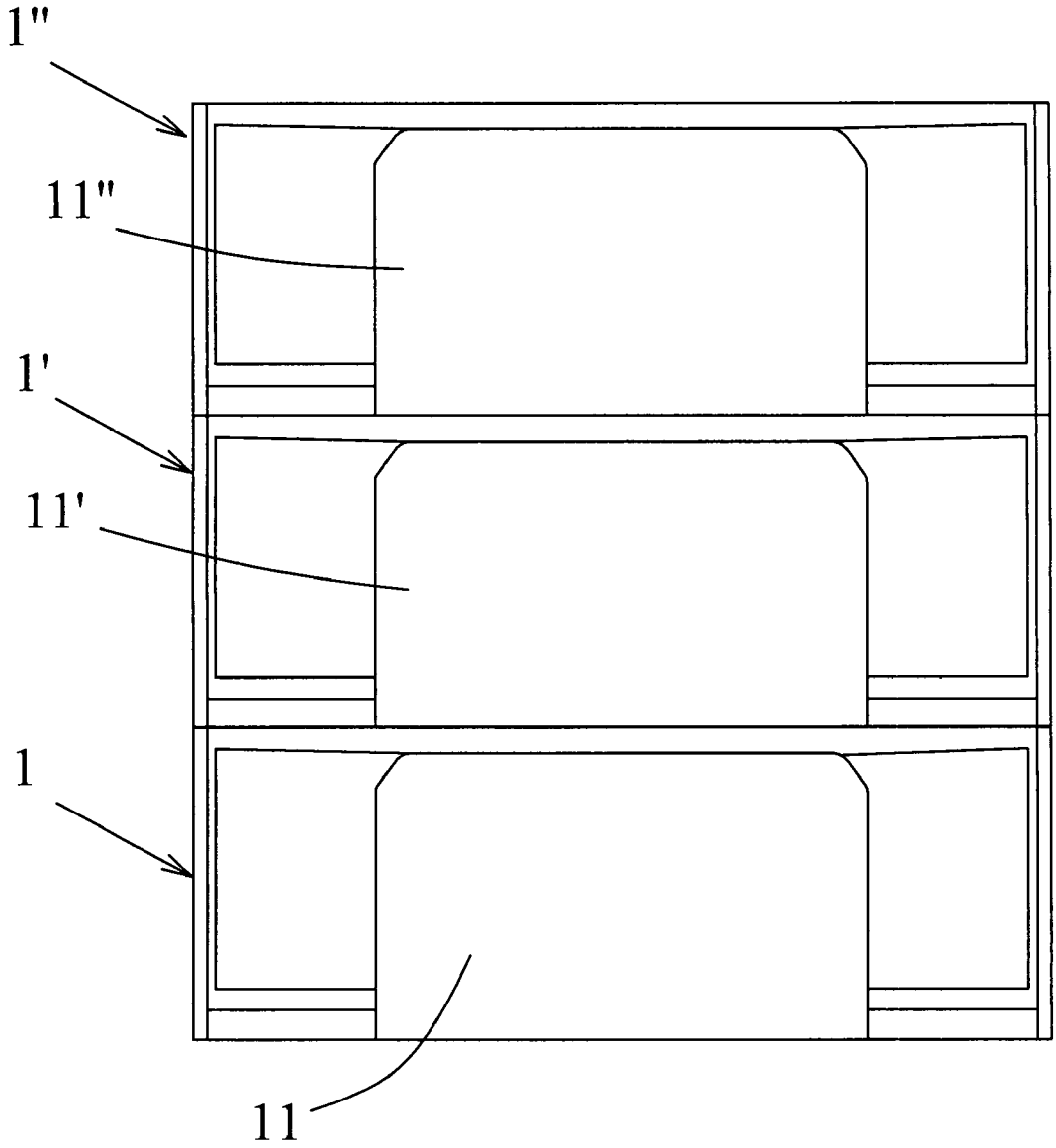
FIG. 1(PRIOR ART)
FIG. 1 is a schematic diagram of a conventional fan assembly.
Figure 2:
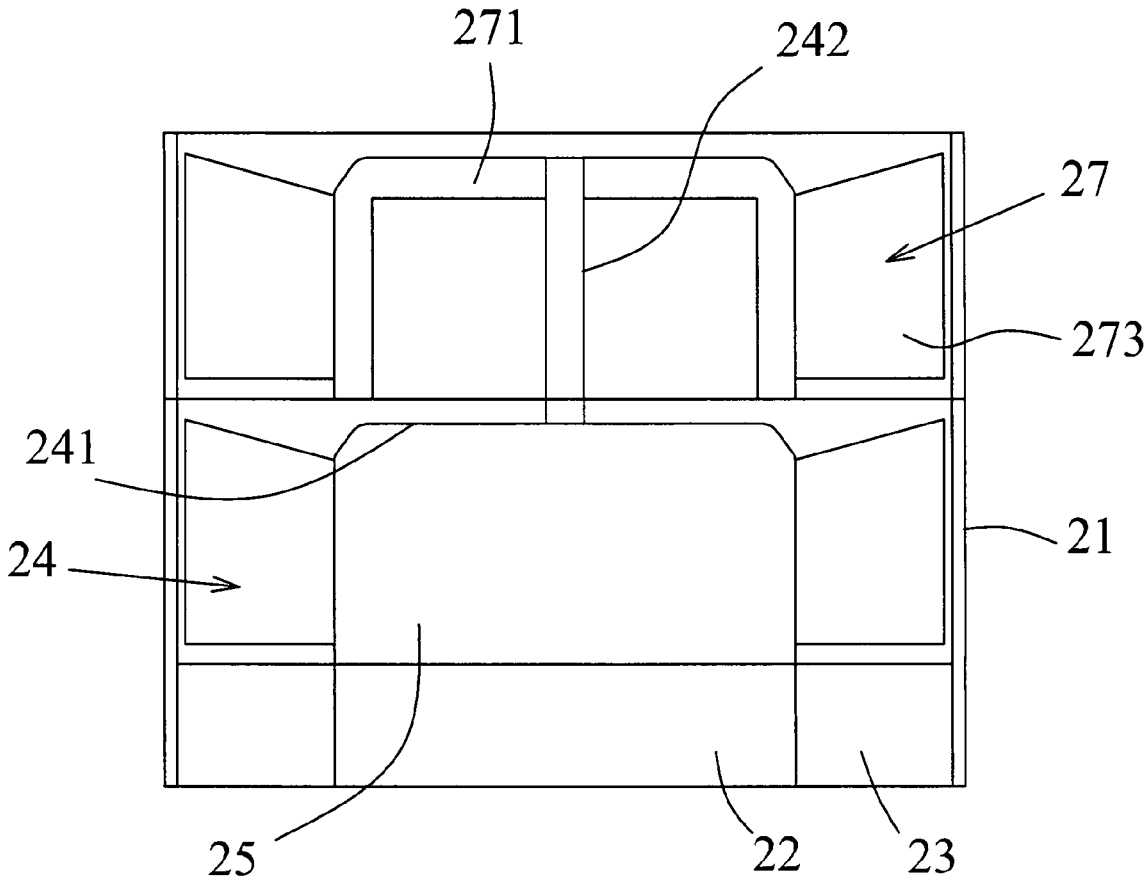
FIG. 2 is a schematic diagram of a first embodiment of fan used in the heat dissipation module of the invention.

First of all, referring to FIG. 2, the first embodiment of fan used in the heat dissipation module of the invention includes an outer frame 21, a base 22, and a plurality of supporting members 23, a first rotor 24, a driving device 25 (for example, a motor) and a second rotor 27.

The base 22 is disposed in the outer frame 21. The supporting members 23 are disposed between the base 22 and the outer frame 21. The first rotor 24 includes a shaft 242, a hub 241 and a plurality of first rotor blades 243 disposed around the hub 241. The second rotor 27 includes a hollow hub 271 and a plurality of second rotor blades 273, and is coupled to the shaft 242 of the first rotor 24 and disposed next to the first rotor 24. The driving device 25, e.g. a motor, is supported by the base 22 and disposed within the hub 241 of the first rotor 24 for driving the first rotor 24 and the second rotor 27 simultaneously. The hub 241 of the first rotor 24 includes a first top surface, and the shaft 242 passing through the first top surface of the hub 241 is connected to the hub 271 of the second rotor 27. The shaft 242 of the first rotor 24 and the second rotor 27 are connected by riveting, screwing, adhering or other equivalent ways. That is to say, the second rotor 27 is located at the windward side of the first rotor 24. Thus, the driving device 25 drives the shaft 242 to simultaneously rotate the first and second rotors 24 and 27, assuring the first and second rotors 24 and 27 rotated at the same speed.

Figure 3:
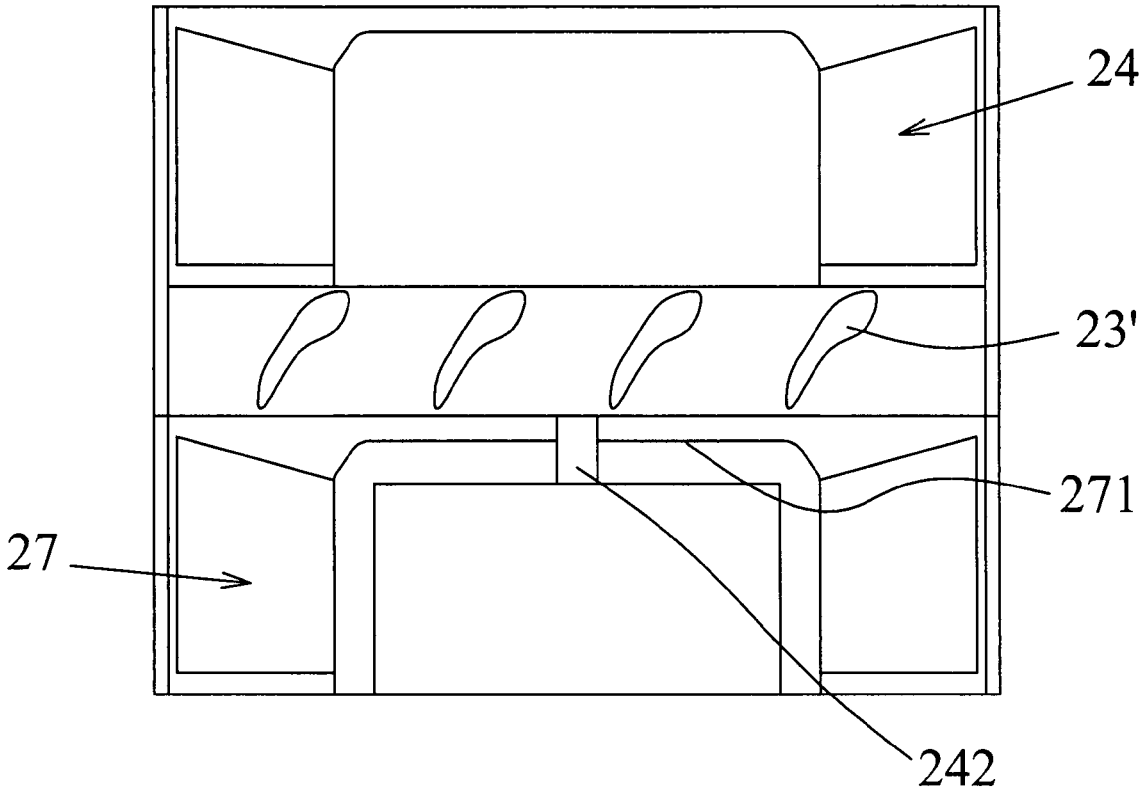
FIG. 3 is a schematic diagram of a second embodiment of fan used in the heat dissipation module of the invention.

FIG. 3 shows the second embodiment of fan used in the heat dissipation module of the present invention. The fan of this embodiment differs from that of the first embodiment in that the second rotor 27 is disposed at the rear end (leeward side) of the first rotor 24, and the supporting ribs 23 are replaced by static blades 23'. The hub 271 of the second rotor 27 has a second top surface and the shaft 242 of the first rotor 24 has an end passing through the second top surface of the hub 271. In this embodiment, the shape of the static blades 23' of the outer frame 21 is similar to that of the first and second rotor blades 243 and 273 of the first and second rotors 24 and 27, or the static blade 23' has a wing-shaped structure for increasing airflow pressure.

Figure 4:
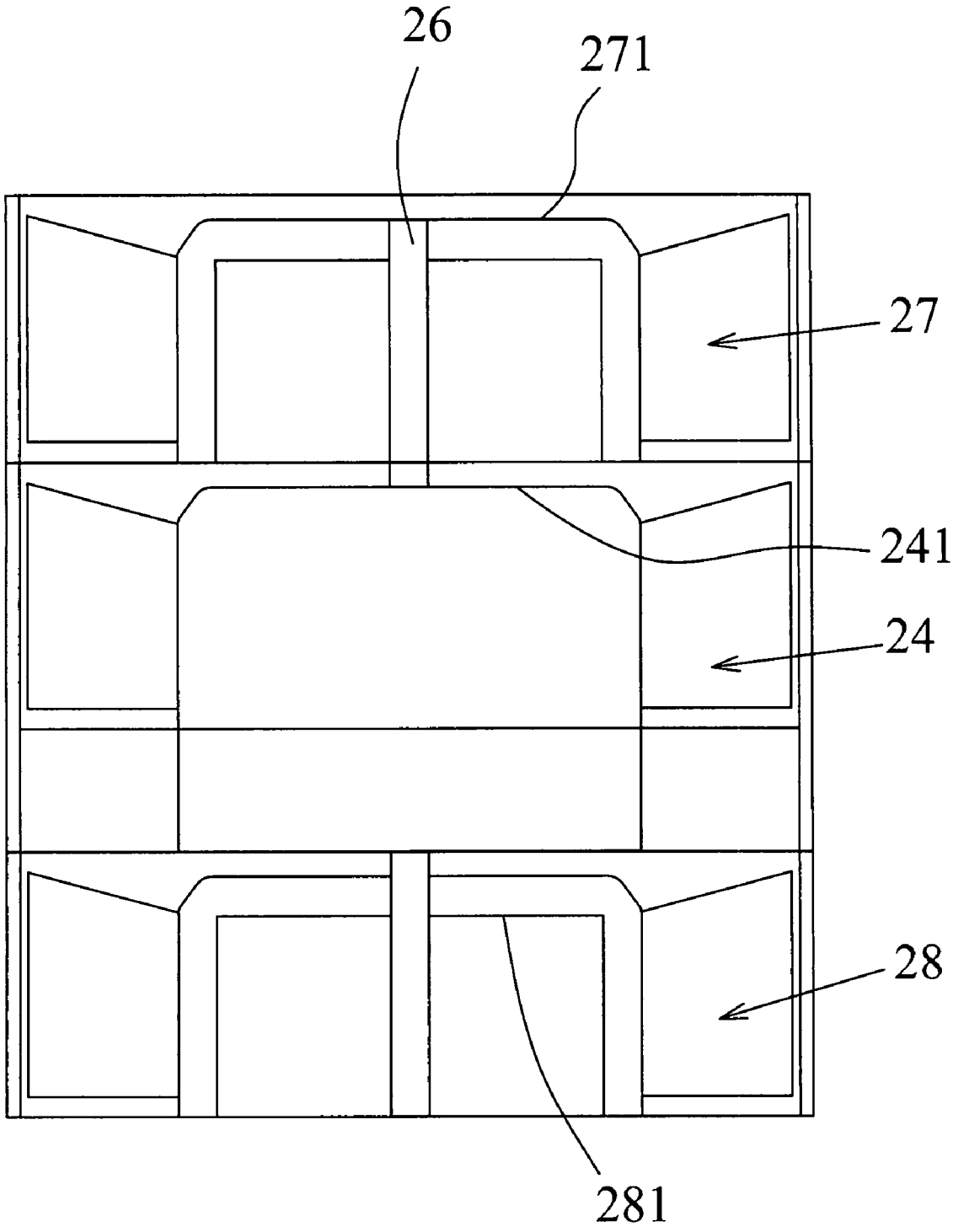
FIG. 4 is a schematic diagram of a third embodiment of fan used in the heat dissipation module of the invention.

Please refer to FIG. 4 showing the third embodiment of fan used in the heat dissipation module of the invention. This fan differs from that of the first embodiment in that the third rotor 28 is further provided and connected to the first rotor 24 in series. The second rotor 27 and the third rotor 28 are disposed at the front end (windward side) and the rear end (leeward side) of the first rotor 24, respectively. One end of the shaft 242 of the first rotor 24 passes through the first top surface of the first rotor 24 to connect with the hub 271 of the second rotor 27, and the other end of the shaft 242 of the first rotor 24 passes through the base 22 to connect with the third hub 281 of the third rotor 28.

Figure 5:
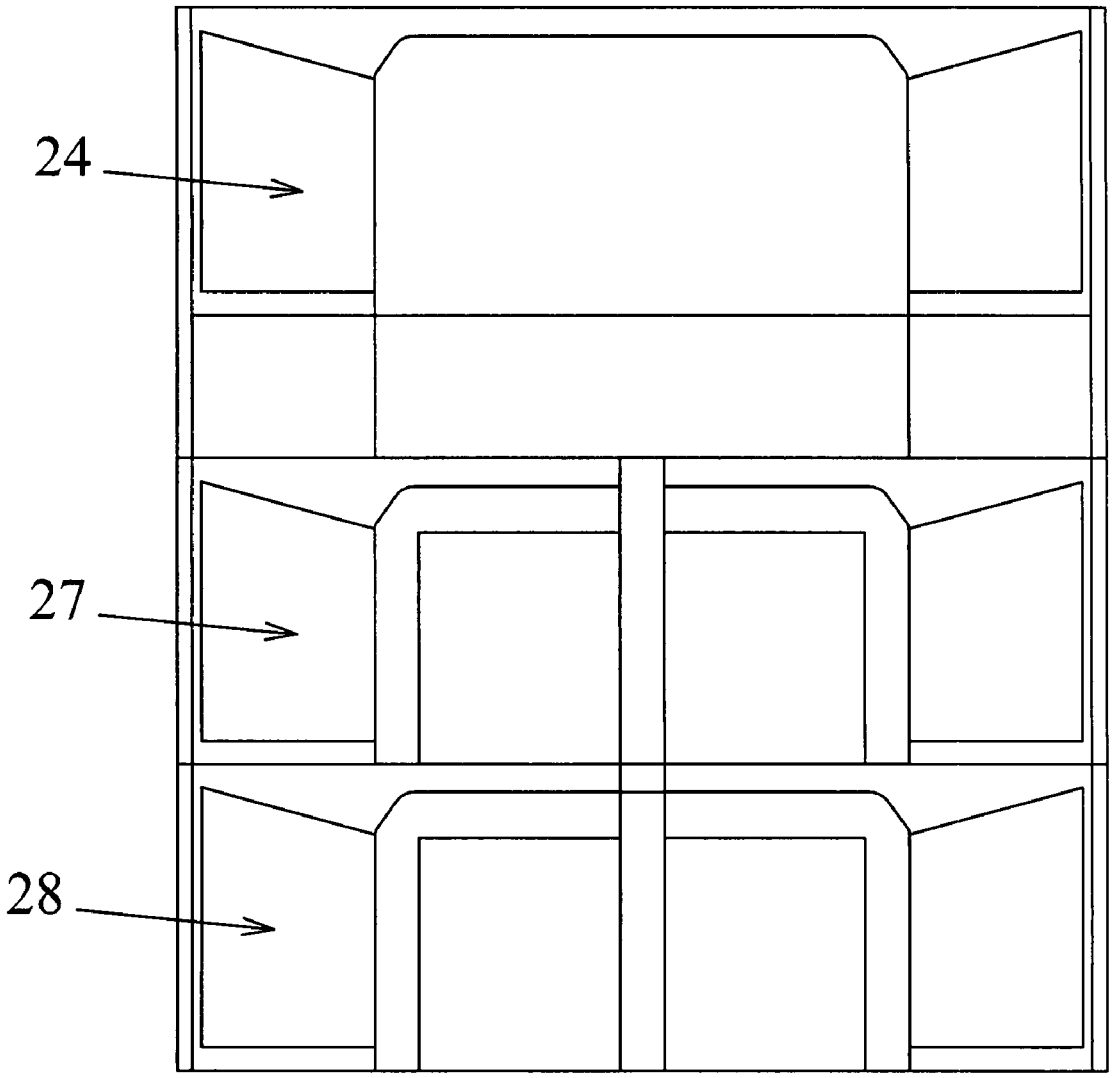
FIG. 5 is a schematic diagram of a fourth embodiment of fan used in the heat dissipation module of the invention.

FIG. 5 shows the fourth embodiment of fan used in the heat dissipation module of the invention. The fan of this embodiment differs from that of the third embodiment in that the second rotor 27 and the third rotor 28 are disposed at the rear end (leeward side) of the first rotor 24. Alternatively, the second rotor 27 and the third rotor 28 can be disposed at the front end (windward side) of the first rotor 24.

Figure 6A:
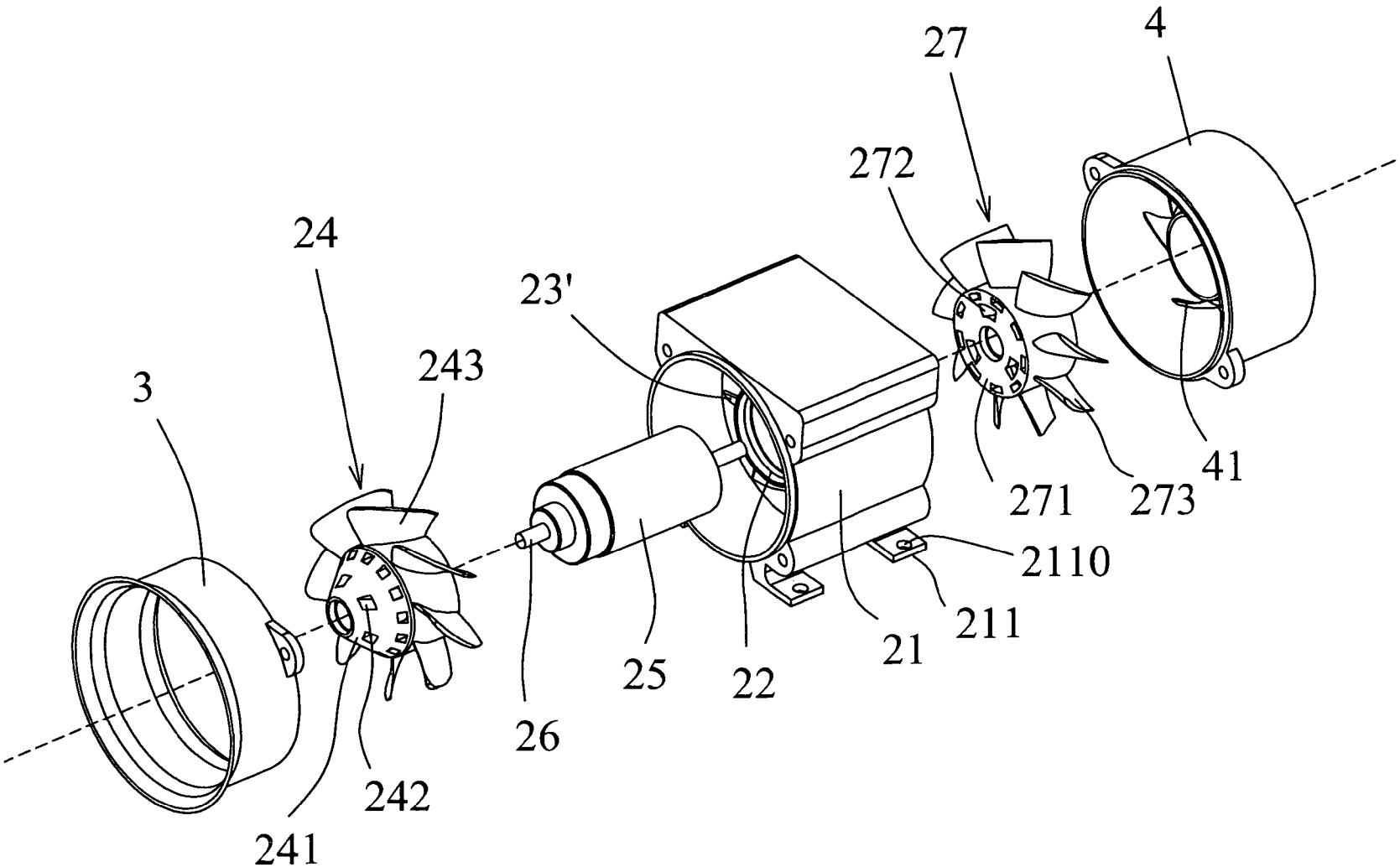
FIG. 6A is an exploded perspective view of a fifth embodiment of fan used in the heat dissipation module of the invention.
Figure 6B:
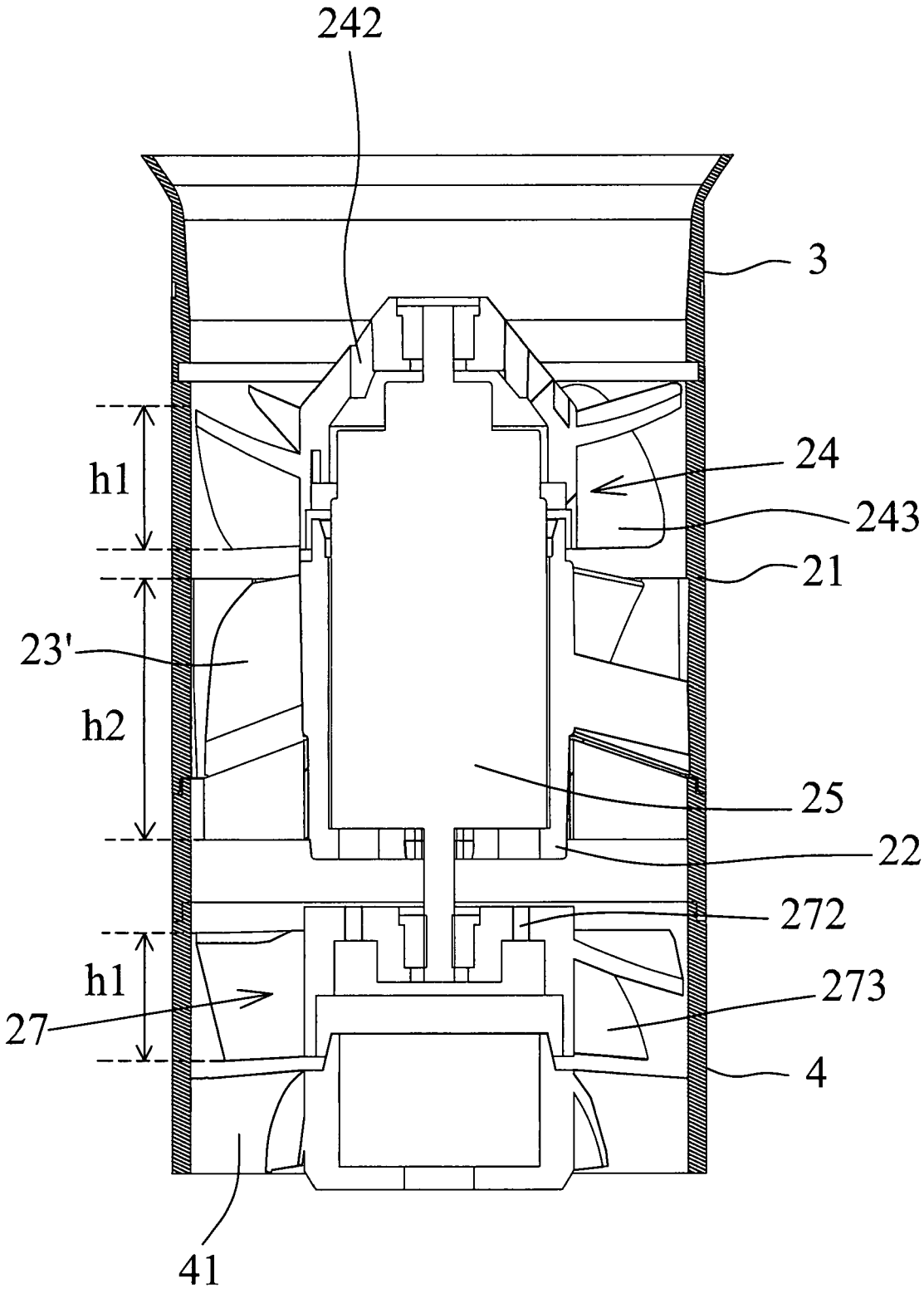
FIG. 6B is a sectional view of the fan of FIG. 6A after being assembled.

FIGS. 6A and 6B show the fifth embodiment of fan used in the heat dissipation module of the invention. The fan includes the outer frame 21 having a plurality of extensions 211 formed with holes 2110, the base 22, the static blades 23', the first rotor 24, the driving device 25, the second rotor 27, a first airflow guiding shroud 3, and a second airflow guiding shroud 4 having a plurality of static blades 41 disposed therein. The fan differs from that of the second embodiment in that the former further includes the first airflow guiding shroud 3 and the second airflow guiding shroud 4 respectively disposed at opposite sides of the outer frame 21. When the airflow passes through the second airflow guiding shroud 4, the airflow is further pressurized by the static blades 41 to increase total heat dissipation efficiency. Alternatively, the static blades can be disposed in the first airflow guiding shroud 3. The static blades 23' disposed between the first rotor 24 and the second rotor 27, particularly to the static blades 23' formed with vertical distal ends, increase workability of the second rotor 27. The first airflow guiding shroud 3 or the second airflow guiding shroud 4 includes an outwardly-slanting or trumpet-like periphery. The outer frame 21 and the first and second airflow guiding shrouds 3, 4 are connected by engaging, locking, screwing or other equivalent ways.

The hub 241 of the first rotor 24 includes a first top surface and a plurality of first dissipating holes 242 formed on the first top surface, and the hub 271 of the second rotor 27 has a second top surface and a plurality of second dissipating holes 272 formed on the second top surface. The first dissipating hole 242 has a first slanted side wall and the second dissipating hole 272 has a second slanted side wall. When the first and second rotors 24 and 27 are actuated by the driving device 25, the intake airflow passes through the first dissipating hole 242 of the first rotor 24 and the second dissipating holes 272 of the second rotor 27 to dissipate heat generated from the driving device 25. The hub 241 of the first rotor 24 has a cone, tapered or slanted surface. The outer frame 21 can be assembled with the external system frame via the extensions 211 and holes 2110 thereof.

The ratio of the height h1 of the first or second rotor blades 243, 273 of the first or second rotors 24, 27 to the height h2 of the static blades 23' of the outer frame 21 ranges from 1/1.1 to 1/1.4. It should be noted that the first and second rotors 24 and 27 are rotated at the same speed, so the number of the first rotor blades 243 of the first rotor 24 is preferably different from that of the second rotor blades 273 of the second rotor 27 to avoid the frequency of the blades from concentrating on the same spot, thereby preventing increased noise. For example, the number of first rotor blades 243 of first rotor 24 is nine and the amount of the second rotor blades 273 of the second rotor 27 is eight or five when the number of static blades 23' of the outer frame 21 is seven. Alternatively, the number of first rotor blades 243 of the first rotor 24 is eight and the number of second rotor blades 273 of the second rotor 27 is nine or five. The first rotor blades 243 of the first rotor 24 and the second rotor blades 273 of the second rotor 27 have an upwardly slanted profile, respectively.

Figure 7A:
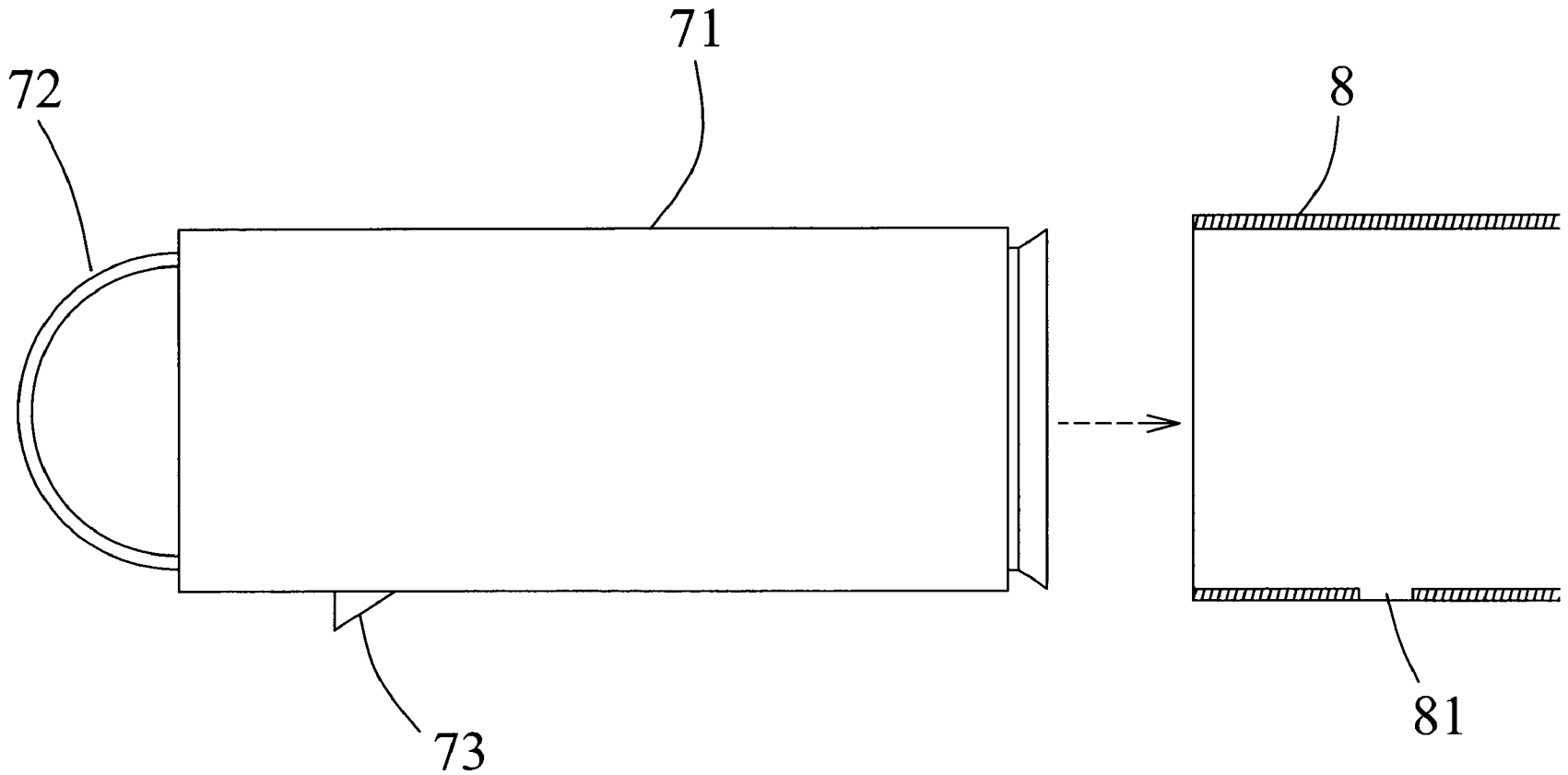
FIG. 7A is a schematic diagram of the heat dissipation module assembled with the system according to the invention.
Figure 7B:
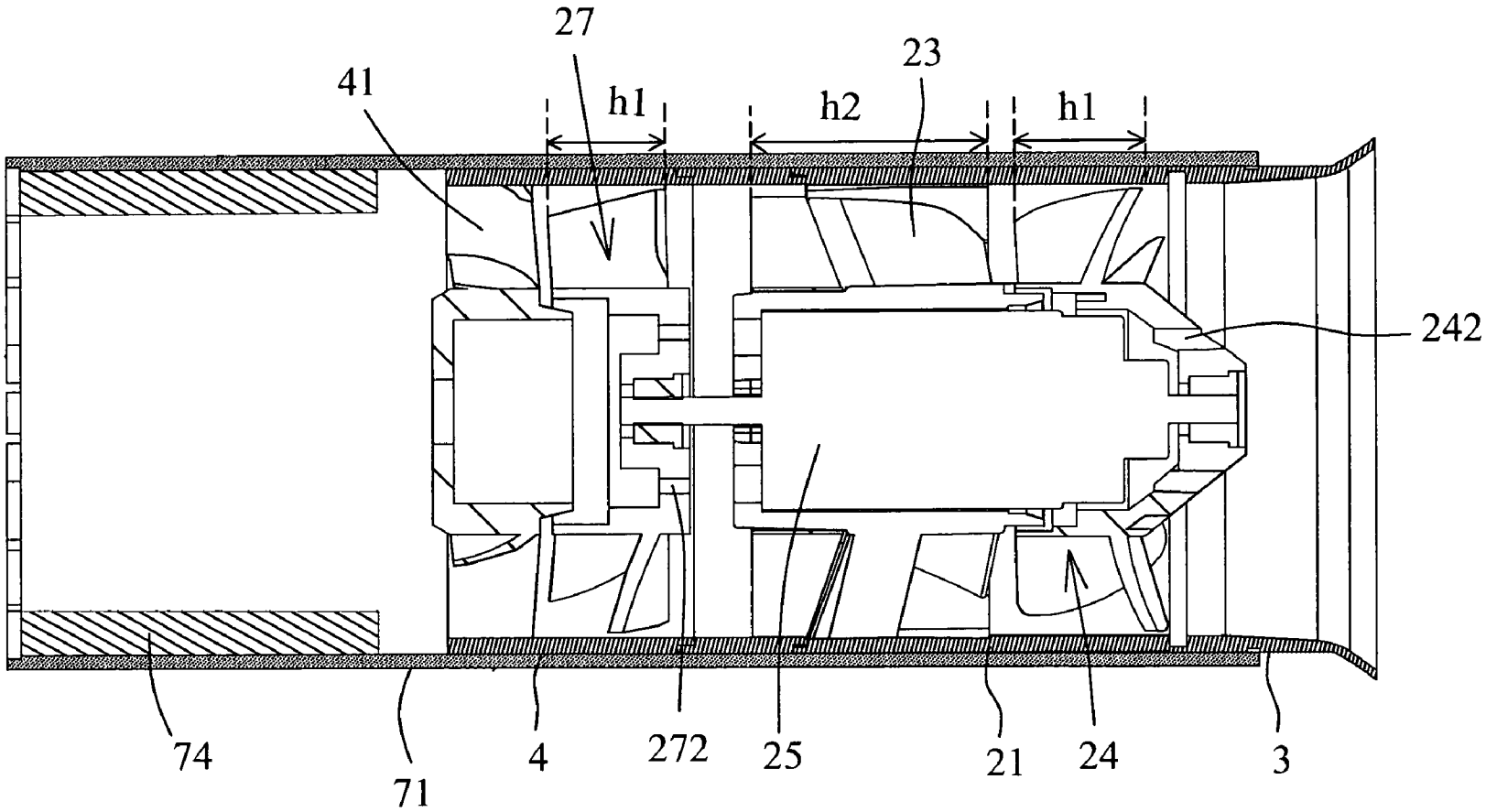
FIG. 7B is a sectional view of the heat dissipation module of FIG. 7A.

According to the present invention, the fan can be designed as a module so as to be simply assembled or disassembled in the system. As shown in FIGS. 7A and 7B, the heat dissipation module includes a handle 72, a securing member 73, a housing 71 and a fan. The handle 72 not only enables users to conveniently carry but also provides users with an applying point to disassemble the module from the system. The securing member 73 can be a hook which will be engaged with a hole 81 of the system frame 8 so as to fix the heat dissipation module to the system. When disassembling the module from the system, the hook can be buried inside the housing 71 by rotating the handle 72 to simply finish the disassembling process.

In addition, the heat dissipation module further includes a voice absorber 74, like a muffler, disposed at the rear side of the static blades 41 to eliminate the noise generated from the heat dissipation module.

In conclusion, the heat dissipation module of the invention utilizes a single high-efficiency motor to drive a plurality of rotors; thus, total volume of a high-efficiency heat dissipation module is reduced. The fans rotating at the low speed achieve the equivalent efficiency like a single fan rotating at the high speed, thereby decreasing the surface stress of the blades and increasing the life of the motor. Furthermore, by using a single motor to drive a plurality of rotors, the number and cost of motors and the manufacturing cost can be reduced. In addition, due to that the rotors are directly rotated by the shaft, additional parts for the rotors, such as metallic cases or magnetic belts, can be eliminated so that material costs are reduced and the manufacturing process is simplified.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A heat dissipation module comprising:

a housing; and a fan disposed in the housing and comprising:

an outer frame;

a first rotor comprising a shaft, a first hub, a plurality of first rotor blades disposed around the first hub, and a plurality of first dissipating holes with a slanted side wall;

a base disposed in the outer frame;

a second rotor comprising a plurality of second rotor blades and a plurality of second dissipating holes with a slanted side wall and coupled to the shaft of the first rotor; and a driving device supported by the base for driving the first rotor and the second rotor.

2. The heat dissipation module according to claim 1, wherein the outer frame comprises a plurality of static blades disposed between the first rotor and the second rotor to increase workability of the second rotor.

3. The heat dissipation module according to claim 2, wherein the static blade comprises a vertical distal end.

4. The heat dissipation module according to claim 2, wherein the height ratio of the first and second rotor blades of the first or second rotors to the static blades ranges from 1/1.1 to 1/1.4.

5. The heat dissipation module according to claim 2, wherein the shape of the static blades of the outer frame is similar to that of the first or second rotor blades, or the static blade of the outer frame comprises a wing-shaped structure.

6. The heat dissipation module according to claim 1, wherein the second rotor further comprises a second hub, the first hub of the first rotor comprises a first top surface, and the shaft passing through the first top surface of the first hub is connected to the second hub of the second rotor by riveting, screwing, adhering or an equivalent way.

7. The heat dissipation module according to claim 1, wherein the second rotor further comprises a second hub having a second top surface, and the end of the shaft of the first rotor passes through the second top surface of the second hub to be coupled with the second rotor by riveting, screwing, adhering or an equivalent way.

8. The heat dissipation module according to claim 1, further comprising a third rotor coupled to the second rotor, the first rotor or both in series.

9. The heat dissipation module according to claim 8, wherein the second rotor further comprises a second hub, the third rotor comprises a third hub, and the shaft of the first rotor comprises a first end passing through a first top surface of the first rotor to connect with the second hub of the second rotor and a second end passing through the base to connect to the third hub of the third rotor.

10. The heat dissipation module according to claim 8, wherein the second rotor further comprises a second hub, the third rotor comprises a third hub, and the shaft of the first rotor passes through the second hub of the second rotor to connect with the third hub of the third rotor.

11. The heat dissipation module according to claim 1, wherein the heat dissipation module further comprises a first airflow guiding shroud disposed at one side of the outer frame.

12. The heat dissipation module according to claim 11, further comprising a second airflow guiding shroud disposed at the other side of the outer frame.

13. The heat dissipation module according to claim 12, further comprising a plurality of static blades disposed in the first or second airflow guiding shroud.

14. The heat dissipation module according to claim 12, wherein the first or second airflow guiding shroud comprises an outwardly-slanting or trumpet-like periphery, and is connected to the outer frame by engaging, locking, screwing or other equivalent ways.

15. The heat dissipation module according to claim 1, wherein the first hub of the first rotor comprises a cone, tapered or slanted surface.

16. The heat dissipation module according to claim 1, further comprising a handle coupled to the housing.

17. The heat dissipation module according to claim 16, further comprising a securing member engaged with an external system frame so as to fix the heat dissipation module to the external system.

18. The heat dissipation module according to claim 17, wherein the securing member comprises a hook which will be buried inside the housing by rotating the handle so as to disassemble the heat dissipation module from the external system.

19. The heat dissipation module according to claim 1, further comprising a voice absorber disposed in the heat dissipation module to eliminate the noise generated from the heat dissipation module.

20. A heat dissipation module comprising:

a housing;

a fan disposed in the housing and comprising:

a frame;

at least one rotor comprising a shaft, a hub and a plurality of rotor blades disposed around the hub;

a base disposed in the frame; and a driving device supported by the base for driving the at least one rotor;

a securing member mounted on the housing; and a handle coupled to the housing, wherein the handle is rotated for assembling /disassembling the heal dissipation module with/from an external system.

21. The heat dissipation module according to claim 20, further comprising a voice absorber disposed in the heat dissipation module to eliminate the noise generated from the heat dissipation module.

22. A heat dissipation module comprising:

a housing;

a handle coupled to the housing;

a securing member engaged with an external system frame so as to fix the heat dissipation module to the external system, wherein the securing member comprises a hook which will be buried inside the housing by rotating the handle so as to disassemble the heat dissipation module from the external system; and a fan disposed in the housing and comprising:

an outer frame;

a first rotor comprising a shaft, a first hub and a plurality of first rotor blades disposed around the first hub;

a base disposed in the outer frame;

a second rotor comprising a plurality of second rotor blades and coupled to the shaft of the first rotor; and a driving device supported by the base for driving the first rotor and the second rotor.

* * * * *